US007185659B2

(12) United States Patent
Sharpe

(10) Patent No.: US 7,185,659 B2
(45) Date of Patent: Mar. 6, 2007

(54) INDUCTIVE HEATING MAGNETIC STRUCTURE FOR REMOVING CONDENSATES FROM ELECTRICAL SMOKING DEVICE

(75) Inventor: David E. Sharpe, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 383 days.

(21) Appl. No.: 10/355,159

(22) Filed: Jan. 31, 2003

(65) Prior Publication Data

US 2004/0149297 A1 Aug. 5, 2004

(51) Int. Cl.
*A24F 3/02* (2006.01)

(52) U.S. Cl. ..... 131/243; 131/194; 131/329

(58) Field of Classification Search ..... 131/194, 131/329, 243; 219/635
See application file for complete search history.

(56) References Cited

U.S. PATENT DOCUMENTS 5,179,966 A 1/1993 Losee et al.
5,222,185 A 6/1993 McCord
5,249,586 A 10/1993 Morgan et al.
5,269,327 A 12/1993 Counts et al.
5,349,586 A 9/1994 Katsuta
5,388,594 A 2/1995 Counts et al.
5,505,214 A 4/1996 Collins et al.
5,530,225 A 6/1996 Hajaligol
5,591,368 A 1/1997 Fleischhauer et al.
5,613,505 A 3/1997 Campbell et al.
5,726,421 A 3/1998 Fleischhauer et al.
5,878,752 A 3/1999 Adams et al.
5,954,979 A 9/1999 Counts et al.
5,967,148 A 10/1999 Harris et al.
6,053,176 A 4/2000 Adams et al.

*Primary Examiner*—Dionne W. Mayes
(74) *Attorney, Agent, or Firm*—Buchanan Ingersoll & Rooney PC

(57) ABSTRACT

Thermal cleaning of an electrically heated smoking device, and in particular the removal of condensates formed within the smoking device as a result of extended periods of use, is achieved with a cleaning system that utilizes inductive heating that provides efficient and intense localized heating in the cleaning process. The thermal power of the inductive heating process is increased or the power necessary to activate the inductive heating process is decreased by the addition of a magnetic shell by itself or in combination with a magnetic pin.

6 Claims, 4 Drawing Sheets

INDUCTIVE HEATING MAGNETIC STRUCTURE FOR REMOVING CONDENSATES FROM ELECTRICAL SMOKING DEVICE

TECHNICAL FIELD OF THE INVENTION

The present invention relates to methods and apparatuses for using, cleaning and maintaining heat sources used in electrical smoking systems.

BACKGROUND OF THE INVENTION

Commonly assigned U.S. Pat. Nos. 5,388,594; 5,505,214; 5,530,225; and 5,591,368 disclose various electrically powered smoking systems comprising cigarettes and electric lighters and are hereby expressly incorporated by reference.

The smoking systems referred to above are designed with the intention of providing the user with all the pleasures of smoking while significantly reducing the side stream smoke produced during smoking. The smoking system also allows users the added benefit of reinitiating smoking of a cigarette that has been partially smoked, thereby providing the smoker with the ability to suspend and reinitiate smoking as desired.

In the operation of the smoking system a non-traditional cigarette is inserted in a heating fixture and heating elements are activated to smoke the cigarette. As a result, condensates may form and collect on the heating fixture. The build up of condensates can affect the functionality of the smoking device and may detract from the flavor and overall pleasure experienced by a user of the device. Therefore, it is desirable to periodically clean the heating fixture of the smoking device in order to rid itself of the condensates that may have collected therein.

U.S. Pat. No. 5,878,752, issued Mar. 9, 1999, hereby incorporated by reference, discloses an electrical lighter that has a sleeve, which concentrically surrounds the cigarette heating fixture. The cigarette heater elements transfer heat primarily via conduction to the inner surface of the sleeve and indirectly from this heated inner surface primarily via convection and radiation to other component surfaces to thermally liberate condensates which are deposited thereon during smoking. However, activation of the heating elements may not fully clean the condensates located on other components within the device. A ceramic layer is deposited on the outer surface of the sleeve to electrically insulate a subsequently applied sleeve heating element from the metal sleeve except for an exposed negative contact. In an alternative embodiment, an induction coil for heating the sleeve is shown.

As part of the cleaning process, a cleaning unit, in which the smoking device is placed, may be used to aid in the removal of the condensates that have been liberated by the thermal cleaning. The cleaning unit acts in a manner that draws the volatilized condensates from the smoking device. In this process of removing the condensates from the smoking device a catalyst may be used. The volatilized condensates from the smoking device are drawn through the catalyst which breaks down the condensates into primarily water vapor and carbon dioxide. As the catalyst is heated the catalyst becomes more efficient. Thus, the use of inductive heating techniques to heat the catalyst during a cleaning cycle of the smoking device may enhance the performance of the catalyst. However, conventional systems for cleaning the smoking device with the aid of a catalyst have required separate heaters and circuitry for heating the catalyst, which can increase costs and the size of the cleaning system while reducing efficiency.

SUMMARY OF THE INVENTION

The present invention provides methods and apparatus that enhance inductive heating techniques for the purpose of removing condensates formed within an electrically heated cigarette smoking device. Embodiments of the present invention include a magnetic shell that surrounds inductive heating elements such as radio-frequency excitation coils, which induce electrical current in metallic components of the smoking device. The metallic components, such as a cylindrical canister positioned around the heater blades for the purpose of directing air flow and capturing condensates that are not inhaled by the user, constitute the heating target. The induced electrical current heats the components and volatilizes any condensates that may be collected on the components. The magnetic shell captures elements of the stray magnetic flux and couples that energy to the heating target.

A secondary embodiment of the invention provides a magnetic pin which is placed in the center of the cigarette heater, surrounded by the heating blades. The magnetic pin in combination with the magnetic shell provides an increase in coupled power to the heating target of up to 300% over a similar inductive heating technique performed without the magnetic elements. Thus, an increase in heating power is obtained over the heating power without the magnetic elements using the same amount of energy. Therefore, decreased power may be used to heat the heating target or a greater amount of heating power may be transferred to the heating target.

BRIEF DESCRIPTION OF THE DRAWINGS

The invention will be understood by reading the following detailed description in conjunction with the drawings in which.

DETAILED DESCRIPTION OF THE PREFERRED EMBODIMENTS

Inductive heating techniques provide the user of an electrical smoking device the ability to efficiently liberate the smoking device from condensates that may build up in the device during normal use. When used in conjunction with a cleaning module, the smoking device can be sufficiently cleansed of the liberated condensates in a environmentally friendly manner. The cleaning module can include an inductive coil of consistent or varying configuration that can be placed around a target, such as a circular tube or canister, and driving circuitry provided to maintain resonant circuit conditions for maximizing efficiency and power transfer to the excitation coils. The driving circuitry should be able to create enough power to sufficiently heat the target, which can be in the form of a canister positioned around an arrangement of electrical heater blades. When power is delivered to the inductive coils, electromagnetic flux is created that passes through the canister. The flux causes electric currents to be created within the canister, which in turn causes the canister to increase in temperature.

Figure 1:
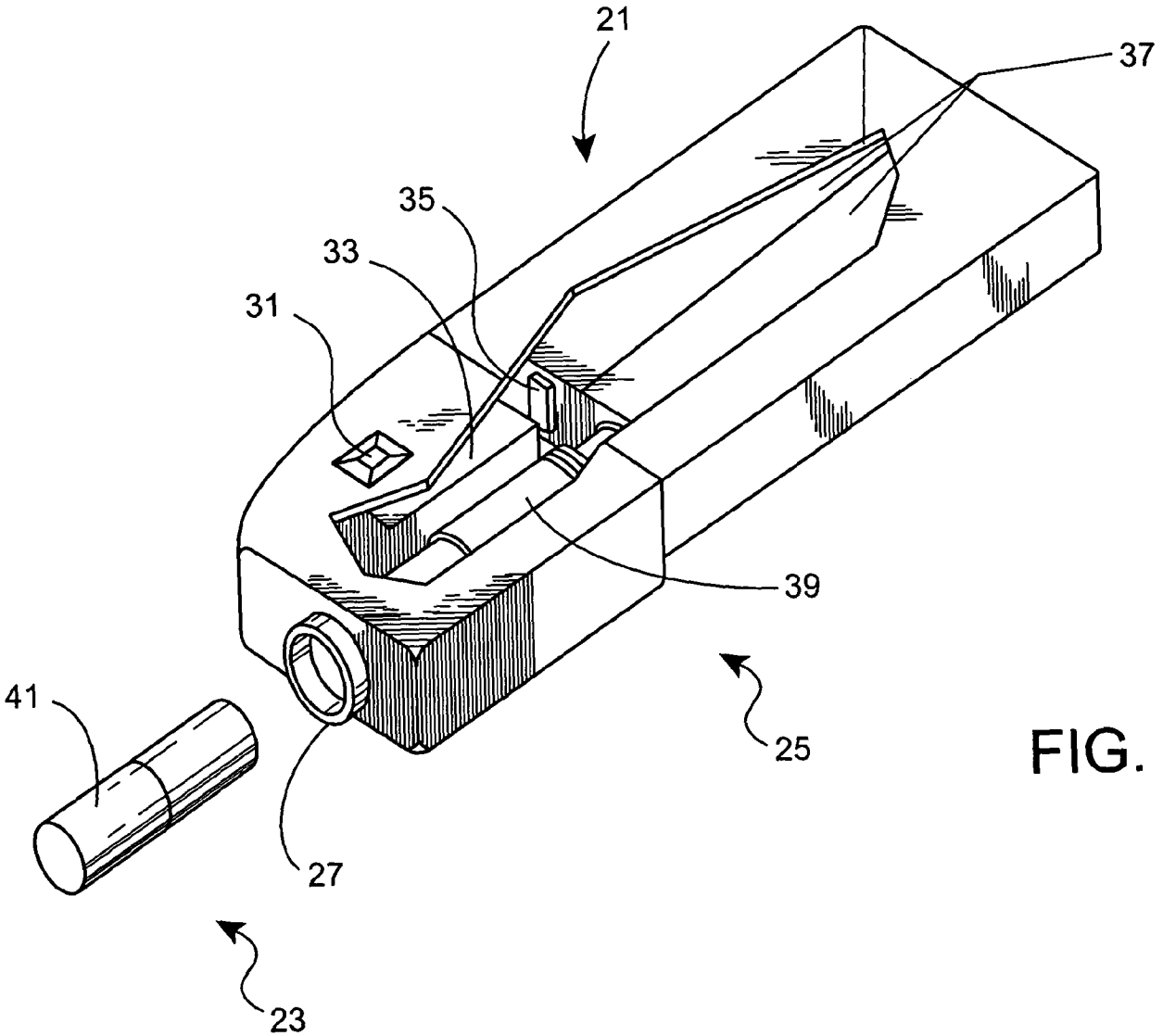
FIG. 1 is an exemplary electrically heated cigarette smoking system with which a cleaning system in accordance with the present invention may be utilized.

The inductive heating techniques of embodiments of the present invention may be used within an electrical smoking system. An exemplary smoking system 21 is illustrated in FIG. 1. The smoking system 21 includes a cylindrical cigarette 23 and a reusable, hand-held lighter 25. The cigarette 23 is adapted to be inserted in and removed from an opening 27 at the front end 29 of the lighter 25. The smoking system 21 is used in much the same way as a conventional cigarette. The user puffs on the cigarette end 41 that protrudes out from the opening 27, thereby obtaining the aroma and flavor associated with the smoke from the combustion of the cigarette 23. When the use of the cigarette 23 has been exhausted, the cigarette 23 is discarded.

The lighter 25 comprises a heating fixture 39, a power source 37, electrical control circuitry 33, a puff sensor 35 and a display indicator 31. The heating fixture 39 contains the heating elements that pyrolyze portions of the cigarette 23 when a puff is taken by the user. The control circuitry 33 controls the amount of power that is delivered to the heating elements of heating fixture 39 from power source 37.

The puff sensor 35 is sensitive to flow or pressure changes and senses when a user draws on cigarette 23. The puff sensor 35 provides a signal to the control circuitry 33, which then activates the appropriate heater blade located within the heating fixture 39. Each heater blade pyrolyzes an adjacent portion or "heater footprint" on the cigarette 23. The display indicator 31 may display various information, such as, the number of puffs that remain, the power level, etc.

Figure 2:
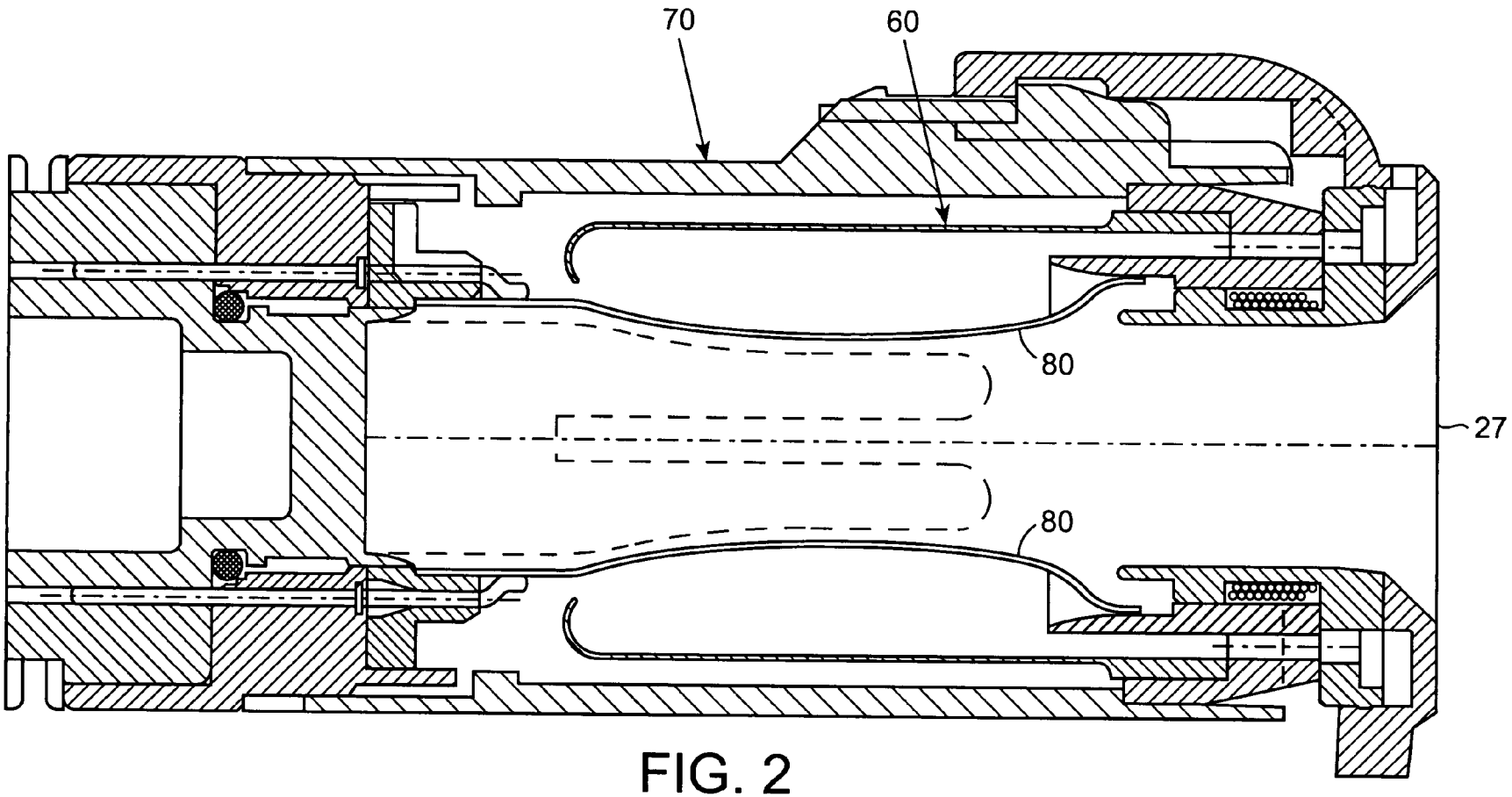
FIG. 2 is an exemplary cross-sectional view of the heating element within an electrically heated cigarette smoking system.

A cross-sectional view of the heating fixture 39 is illustrated in FIG. 2. The heating fixture 39 includes at least an outer housing 70, heating blades 80, a secondary can 60 and an opening 27. Other features of the heating fixture 39 are discussed in commonly assigned U.S. Pat. Nos. 5,591,368 and 5,878,752. The heating blades 80 surround the cigarette when it is placed within the heating fixture 39. In one embodiment the heating fixture 39 comprises eight heating blades 80. However, the heating fixture 39 may have less than or more than eight heating blades 80. The heating blades 80 are activated by the control circuitry 33 which controls which blades are heated, how hot and how long they are heated. The heating blades 80 pyrolyze cigarette 23, which produces the smoke or aerosolized byproducts and condensates.

The secondary can 60 surrounds the heating blades 80. The secondary can 60 acts to direct air flow, keep the outer housing from getting too hot and it collects the condensates in preference to other areas of the heating fixture 39 and smoking device 25. The secondary can 60 can be used to accumulate a large portion of condensates released during the use of the smoking device 25.

Figure 3A:
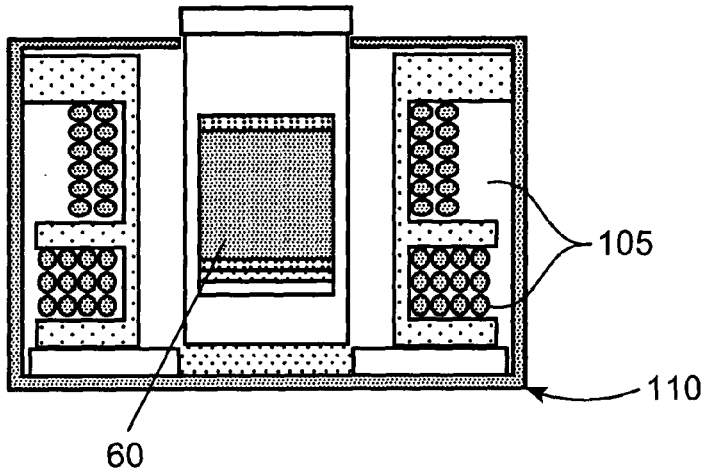
FIG. 3*a* is an exemplary inductive heating element with a magnetic shell of a cleaning system in accordance with the invention.
Figure 3B:
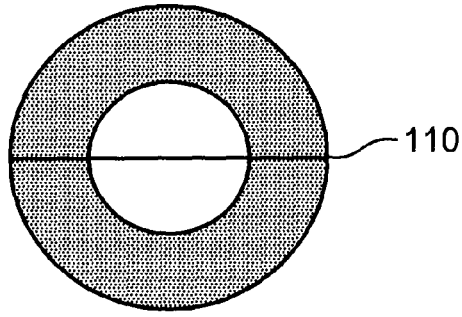
FIG. 3*b* is an exemplary cross-sectional view of the magnetic shell shown in FIG. 3*a*.

As previously discussed, inductive heating techniques may be utilized to thermally liberate the condensates that are built up on various portions of the heating fixture. Illustrated in FIG. 3*a* is an embodiment of the present invention in which an increase in inductive heating power is accomplished by placing a magnetic shell 110 so that it surrounds the heating coils 105 and heating target, preferably in the form of an electrically conductive portion of the heating fixture of an electrically heated cigarette smoking system, which in FIG. 3 is the secondary can 60. The magnetic shell 110 captures stray magnetic flux generated by the inductive heating process. This stray magnetic flux is then coupled into the heating target. With the use of a magnetic shell 110, an increase in the inductive power delivered to the heating element can be increased as much as 30%. FIG. 3*b* illustrates the magnetic shell 110 as seen from the front or rear of the heating elements that the magnetic shell 110 surrounds.

Figure 4:
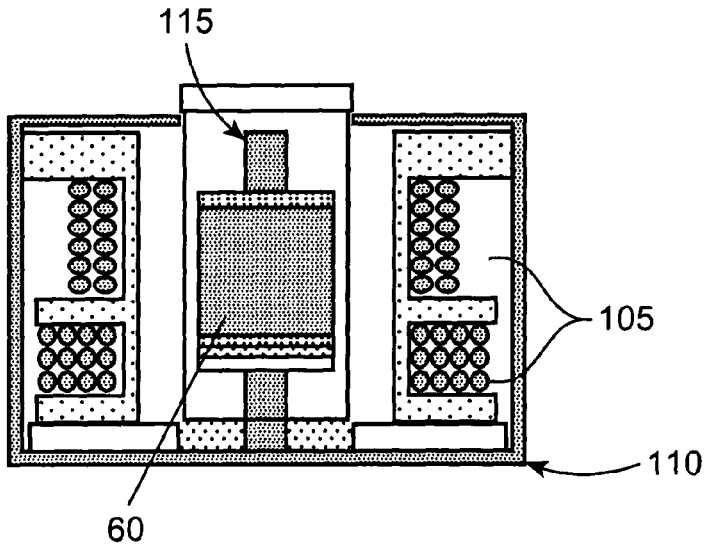
FIG. 4 is an exemplary inductive heating element with a magnetic shell and magnetic pin of a cleaning system in accordance with the invention.

FIG. 4 illustrates another embodiment of the present invention in which a magnetic pin 115 is placed between the secondary can 60 and the heating blades, which are enclosed by the secondary can 60. The magnetic pin 115 captures a large amount of stray magnetic flux and couples this energy into the secondary can 60. The combination of both the magnetic shell 110 and the magnetic pin 115 captures almost all the stray magnetic flux and couples this energy to the heated element, i.e. secondary can 60. Thus, magnetic flux is primarily directed to the heating element rather than other metallic elements in the smoking system. The magnetic material used in the magnetic shell 110 and magnetic pin 115 may be any permeable magnetic material such as a ferrite or ferro-dielectric material.

The combination of the magnetic shell 110 and pin 115 provides an increase in the thermal energy supplied to the heated element of upwards to 300% compared to inductive heating without the use of a magnetic shell 110 and pin 115. Therefore, if desired, the amount of thermal power delivered to the heated element can be reduced to one-third the power that would used by inductive heating coils without a magnetic shell and pin. Further, EMI emissions would be expected to be reduced significantly, i.e., by at least one-third. Thus, the cleaning system, which can be powered by direct current or alternating current, is provided with a longer battery life or lower power consumption, and having reduced EMI emissions.

Figure 5A:
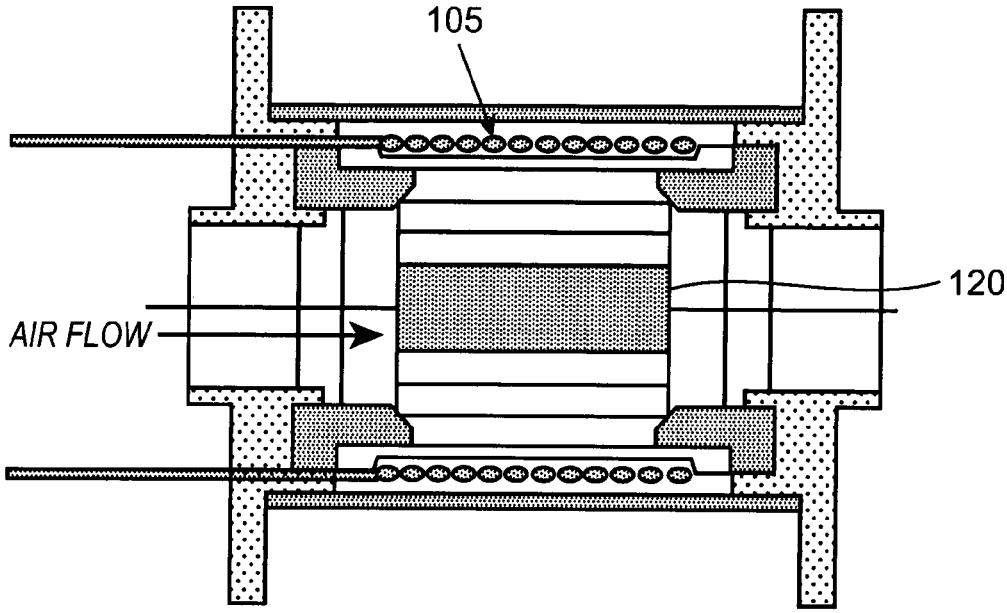
FIG. 5*a* is an exemplary inductive heating element with a catalyst of a cleaning system in accordance with the invention.
Figure 5B:
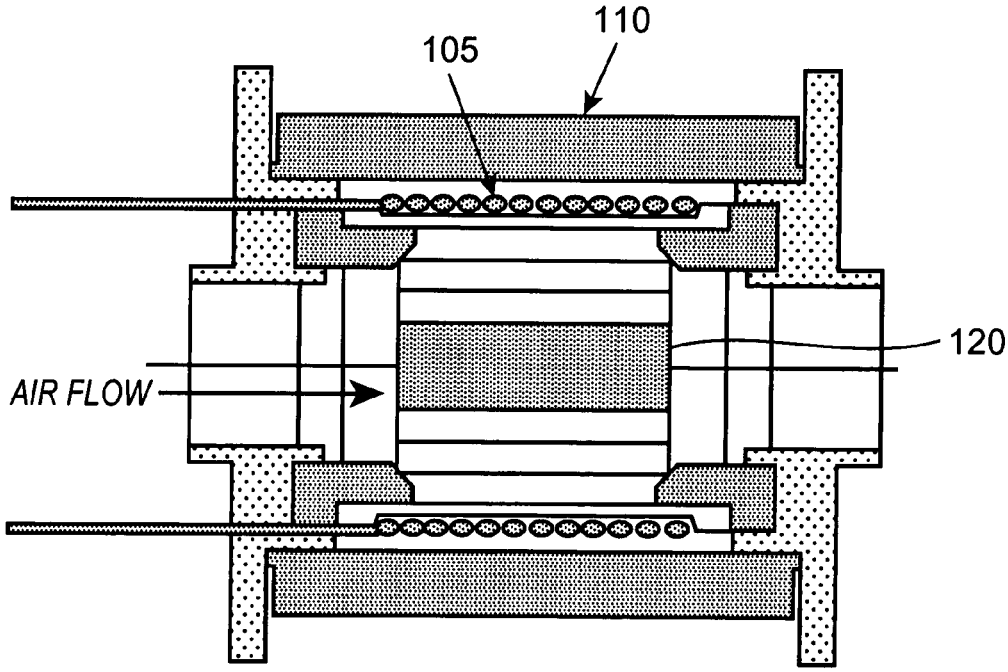
FIG. 5*b* is an exemplary inductive heating element with a magnetic shell and catalyst of a cleaning system in accordance with the invention.

FIGS. 5*a* and 5*b*, illustrate an alternative embodiment of the present invention in which a catalyst 120 is used as the heated element. FIG. 5*a* illustrates the arrangement of the catalyst 120 relative to inductive coils 105. The catalyst may be used to capture any particles that may be in the air withdrawn from the smoking device undergoing cleaning, or to chemically treat the gases produced during the cleaning process. The heating of the catalyst 120 increases the effectiveness of the catalyst 120 as air is drawn through it.

FIG. 5*b* is the heating arrangement of FIG. 5*a* with the addition of the magnetic shell 110 that surrounds the inductive heating coils 105. The addition of the magnetic shell 110 increases the thermal energy applied to the catalyst 120 in the same manner as discussed above.

While this invention has been described in conjunction with the exemplary embodiments outlined above, it is evident that many alternatives, modifications and variations will be apparent to those skilled in the art. Accordingly, the exemplary embodiments of the invention may be made without departing from the spirit and scope of the invention.

We claim:

1. A cleaning apparatus in combination with an electrically heated cigarette smoking device for thermally cleaning condensates from elements within the electrically heated cigarette smoking device, the combination comprising:

inductive coils which are part of an inductive heating element;

a target element desired for thermal cleaning; wherein the target element is a metallic component within the electrically heated cigarette smoking device, said electrically heated cigarette smoking device further including a plurality of heater elements for pyrolyzing a tobacco product; and a magnetic shell;

wherein the magnetic shell is located around the target element so that the target element may be inductively heated, and wherein the magnetic shell captures stray magnetic flux created during the heating of the target element and couples this energy into the target element.

2. The apparatus of claim 1, wherein said metallic component is a cylindrical canister positioned radially outward from said heater elements.

3. The apparatus of claim 1, wherein the energy coupled by the magnetic shell enhances the thermal energy within the target element.

4. The apparatus of claim 1, wherein the amount of power delivered to the inductive coils is reduced multiplicatively by the amount of increase in thermal energy to the target element created from the coupled energy of the magnetic shell.

5. The apparatus of claim 1, wherein the permeable magnetic shell is ferrite.

6. The apparatus of claim 1, wherein the magnetic shell is ferro-dielectric.

* * * * *